US006448936B2

(12) United States Patent
Kopf et al.

(10) Patent No.: US 6,448,936 B2
(45) Date of Patent: Sep. 10, 2002

(54) RECONFIGURABLE RESONANT CAVITY WITH FREQUENCY-SELECTIVE SURFACES AND SHORTING POSTS

(75) Inventors: David E. Kopf, Nashua; Zane Lo, Merrimack, both of NH (US)

(73) Assignee: BAE Systems Information and Electronics Systems Integration Inc., Nashua, NH (US)

( * ) Notice: Subject to any disclaimer, the term of this patent is extended or adjusted under 35 U.S.C. 154(b) by 34 days.

(21) Appl. No.: 09/808,865

(22) Filed: Mar. 15, 2001

Related U.S. Application Data

(60) Provisional application No. 60/190,372, filed on Mar. 17, 2000.

(51) Int. Cl.[7] ..... H01Q 13/10; H01Q 1/48; H01Q 15/02

(52) U.S. Cl. ..... 343/767; 343/846; 343/909

(58) Field of Search ..... 343/700 MS, 767, 343/846, 829, 909, 756, 876

(56) References Cited

U.S. PATENT DOCUMENTS

| | | | | |
|---|---|---|---|---|
| 4,379,296 A | * | 4/1983 | Farrar et al. | 343/700 MS |
| 4,443,802 A | * | 4/1984 | Mayes | 343/729 |
| 5,416,971 A | * | 5/1995 | Hegazi et al. | 343/770 |
| 6,239,750 B1 | * | 5/2001 | Snygg | 343/700 MS |

* cited by examiner

*Primary Examiner*—Don Wong
*Assistant Examiner*—Hoang Nguyen
(74) *Attorney, Agent, or Firm*—Salzman & Levy

(57) ABSTRACT

The present invention features a reconfigurable resonant cavity specifically for use with a slot radiator. A series of internal planes with frequency-selective materials disposed on their top surfaces, in conjunction with switchable shorting pins, is used to reconfigure the cavity's resonant frequency. PIN diodes, MEMS or other photonically or electrical activated switching devices may be used to selectively "activate" shorting pins. A single resonant cavity may be electrically reconfigured to operate at two, three, or even more different frequency bands.

17 Claims, 2 Drawing Sheets

RECONFIGURABLE RESONANT CAVITY WITH FREQUENCY-SELECTIVE SURFACES AND SHORTING POSTS

This application claims the benefit of provisional application No. 60/190,372 filed on Mar. 17, 2000.

FIELD OF THE INVENTION

The present invention relates to resonant cavities and, more particularly, to a reconfigurable resonant cavity for use in conjunction with a slot antenna element to provide broadband operation of the antenna at more than one selected frequency band.

BACKGROUND OF THE INVENTION

Slot radiators exhibit increased gain, typically 3 dB, when placed over a resonant cavity. Because the resonant cavity provides a high Q, the operational bandwidth of the system is limited.

Using a resonant cavity behind a slot is the primary solution for maximizing gain from a slot element.

It is, therefore, an object of the invention to provide a reconfigurable resonant cavity which results in high gain, broadband performance from an integrated slot radiator.

It is another object of the invention to provide a reconfigurable resonant cavity which includes movable "fences" which define the effective size of the cavity.

It is a further object of the invention to provide a reconfigurable resonant cavity which implements "fences" by using selectable shorting pins.

It is still another object of the invention to provide a reconfigurable resonant cavity which uses frequency- selective surface materials (FSS) to control the resonant frequency of the cavity.

SUMMARY OF THE INVENTION

In accordance with the present invention there is provided a reconfigurable resonant cavity for use with a slot radiator. Selectable, electrically conductive posts, operating in cooperation with FSS material, are used to define movable cavity walls, resulting in multiple, selectable, predetermined resonant frequencies of operation for the cavity. Microelectromechanical switches (MEMS) or other photonically or electrically operated switching devices are used to activate and deactivate the electrically conductive posts so as to effectively move the cavity walls.

BRIEF DESCRIPTION OF THE DRAWINGS

A complete understanding of the present invention may be obtained by reference to the accompanying drawings, when considered in conjunction with the subsequent detailed description, in which.

DESCRIPTION OF THE PREFERRED EMBODIMENT

Resonant cavities placed beneath slot radiators are well known for enhancing the gain of slot radiators. Gain enhancements in the range of 3 dB are typical. However, the resonant cavity provides this phenomena over a limited bandwidth and is, therefore, unsuited for broadband applications. The reconfigurable resonant cavity of the present invention overcomes this difficulty.

Figure 1:
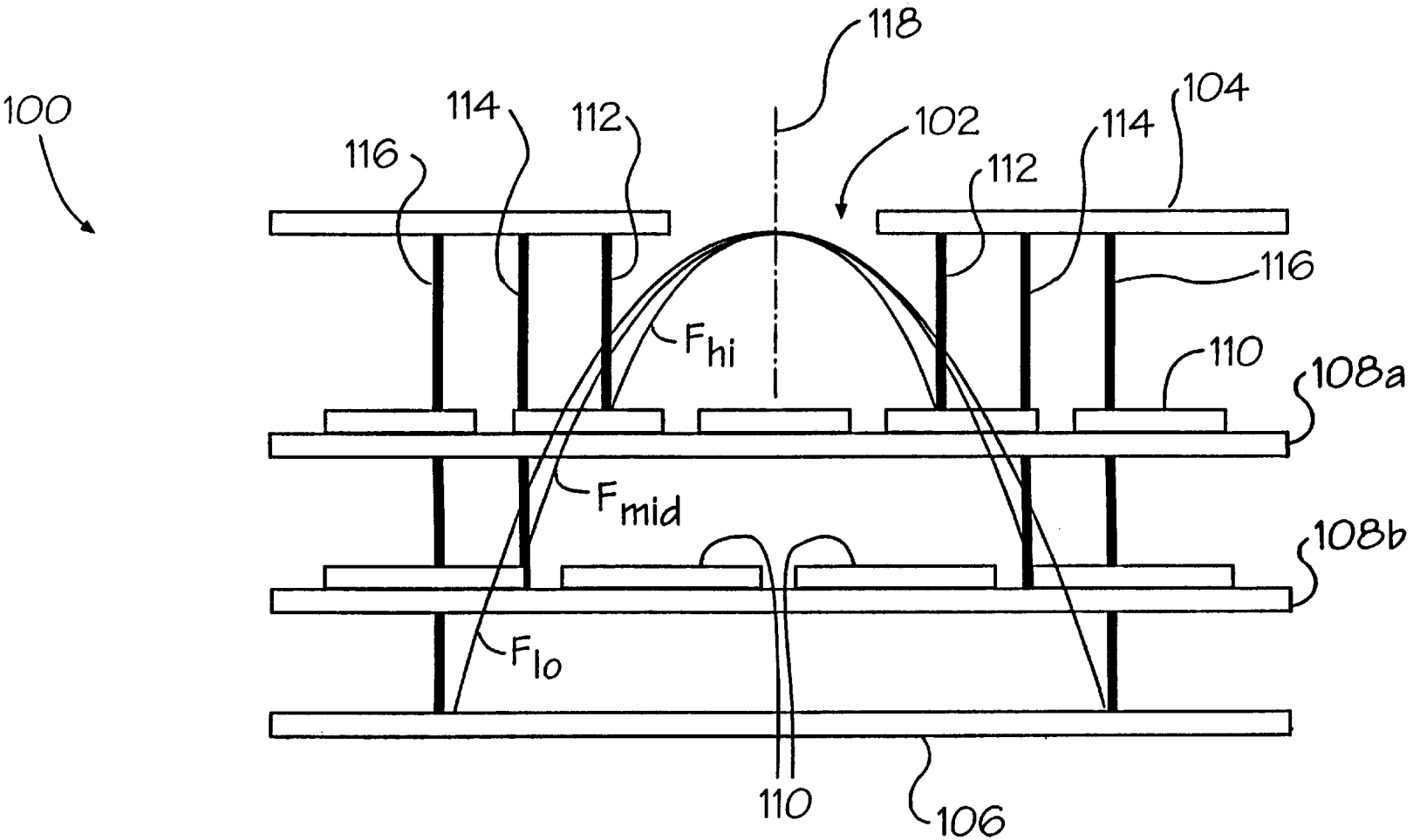
FIG. 1 is a schematic, cross-sectional view of the reconfigurable resonant cavity of the invention.

Referring now to FIG. 1, there is shown a side, schematic view of the reconfigurable resonant cavity of the invention, generally at reference number 100. For purposes of disclosure, cavity 100 is shown configured for three-band operation. However, it should be obvious that by altering the number of dielectric/FSS layers and the number and/or location of the conductive posts, the inventive cavity may be configured to operate in more than three frequency bands.

A slot 102 is shown in an upper conductive plane 104. The slot 102 is configured in accordance with welt known principles and forms no part of the instant invention. A reconfigurable slot is ideal for use with the inventive reconfigurable cavity of the present invention. A lower ground plane 106 is located substantially parallel to and spaced apart from upper conductive plane 104, thereby defining the maximum depth of the resonant cavity 100 and, therefore, the lowest frequency of operation.

Two dielectric layers 108*a,* 108*b* are disposed in cavity 100, layers 108*a,* 108*b* also being substantially parallel to both upper conductive plane 104 and lower ground plane 106. Selectively disposed on the top surface of dielectric layers 108*a,* 108*b* are resonant elements of frequency selective surface material 110 to form intermittent frequency-selective surfaces (FSS) on dielectric layers 108*a,* 108*b*.

By using frequency selective materials having different unit cell periodicites, the absorption and reflection characteristics of the surfaces may be controlled. This allows cavity 100 to form a well-behaved resonator at each of the frequency bands to which it may be tuned. In addition, resonant elements of frequency selective material 110 helps control the Q of the resonator. Each dielectric layer 108*a,* 108*b* carrying resonant elements of frequency selective surface material 110 defines a potential alternate bottom ground plane for cavity 100.

These alternate bottom ground planes 108*a,* 108*b* must have their respective FSS layers electrically connected to upper conductive plane 104 for them to become effective ground planes. These connections are made by means of conductive posts 112, 114, 116 located on either side of a vertical centerline 118 of slot 102.

Pairs of posts 112 are located the closest to centerline 118 and extend only between upper conductive plane 104 and a first dielectric layer 108*a*. This defines the smallest of the resonant cavity configurations suitable for operation at an arbitrary frequency $F_{hi}$.

Similarly pairs of posts 114 are located further away from centerline 118 and connect dielectric layer 108*b* to upper conductive plane 104. This defines a somewhat larger configuration of a resonant cavity for operation at an arbitrary frequency $F_{mid}$.

Finally, pairs of posts 116 are located still further away from centerline 118 and connect lower ground plane 106 to upper conductive plane 104, thereby defining the largest possible configuration of resonant cavity suitable for operation at an arbitrary frequency $F_{low}$.

Optimally, shorting posts 116 may be fixed, permanent connections, as well as switched.

As previously mentioned, additional dielectric layers with FSS material could be added along with additional sets of shorting posts to define additional resonant frequencies for cavity 100.

Figure 2:
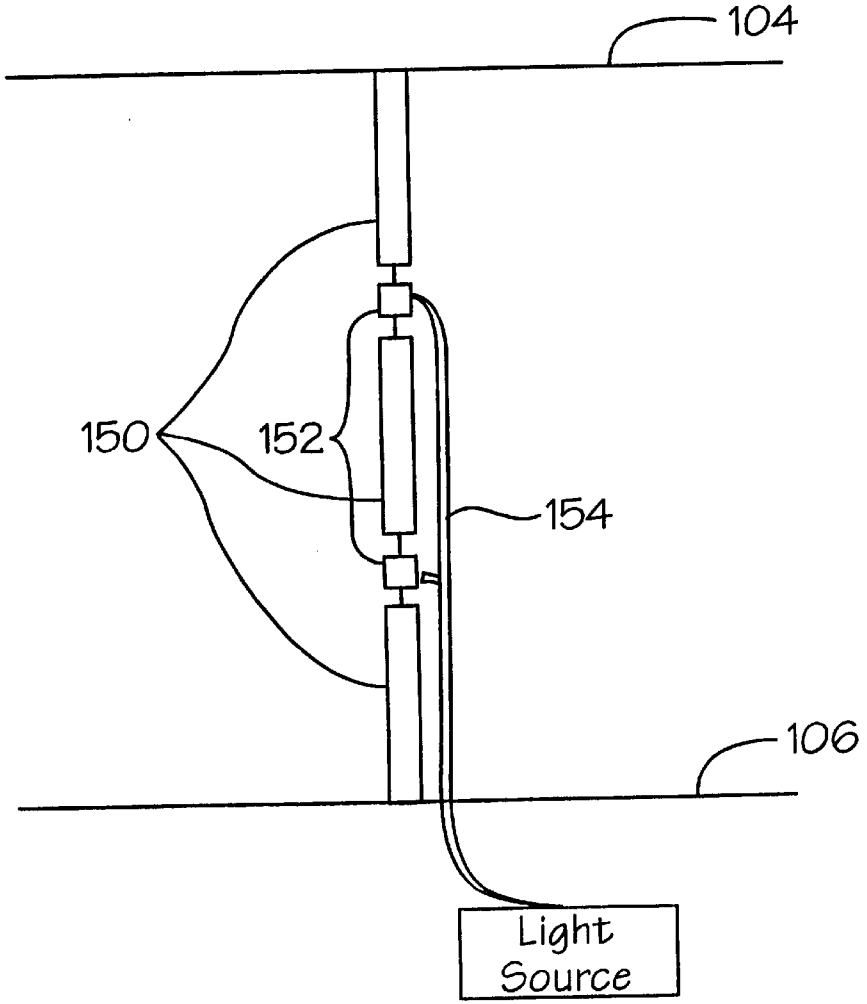
FIG. 2 is a schematic view of a light-activated, switched shorting post for use in the resonant cavity of FIG. 1.

Referring now also to FIG. 2, there is shown a schematic representation of a light-activated switching arrangement suitable for switching posts 112, 114, 116. Shorting posts 112, 114, 116 may be implemented in a number of ways. Typically, optically activated microelectromechanical switches (MEMS) 152 are used. The MEMS 152 may be mounted on a small substrate (not shown) which is mounted in a small, composite metalized tube 150. An optical control fiber 154 is attached to the MEMS 152 and exits the cavity 100. The tube 150 is mounted vertically between dielectric layers 108*a,* 108*b* and/or conductive upper plane 104 and ground plane 106. Reliable contact must be made at both ends of the composite metalized tube 150. The reliability of this configuration is highly dependent upon the flexibility of the tube 150 and the rigidity of the cavity structure 100 itself. The advantage of optically controlled switches such as MEMS 152 is that only non-metallic fibers 154 enter the cavity. In alternate, electrically activated switching embodiments, metallic conductors (not shown) must enter cavity 100. These metallic conductors may interfere with the operation of the resonant cavity 100 either by de-tuning the cavity 100 or by introducing interfering signals into the cavity 100.

In alternate embodiments, FET switches, not shown, may be used to connect shorting posts 112, 114, 116 to their respective upper plane 104, ground plane 106 and/or dielectric layers 108*a,* 108*b*. In still other embodiments, PIN diodes or other optically controlled switches, not shown, may be used for switching posts 114, 116. PIN diodes convert light energy, typically in the 0.75–1 micron wavelength range to electrical signals. The disadvantage of PIN diodes is that they typically require a bias current to form a low-resistance contact. This bias current may be supplied through RF chokes, but this adds complexity and cost and may also introduce components into cavity 100 which may interfere with its operation.

In another embodiment, the switched shorting posts 112, 114, 116 themselves are formed from semiconductor material. When this semiconductor material is illuminated by laser light of an appropriate wavelength, sufficient free carriers are liberated, making the posts 112, 114, 116 sufficiently conductive at the frequency of interest. The disadvantage of this approach is that posts 112, 114, 116 must be continuously illuminated by the laser in order to remain conductive.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A reconfigurable resonant cavity structure, comprising:

a) a conductive upper plane having a slot therein;

b) a lower ground plane substantially parallel to said conductive upper plane and spaced apart therefrom;

c) a dielectric layer intermediate said conductive upper plane and said lower ground plane;

d) a frequency-selective surface disposed on a surface of said dielectric layer;

e) first shorting posts spaced apart from said slot and electrically connected to said conductive upper plane and to at least one of said lower ground plane and said frequency-selective surface; and f) second shorting posts disposed intermediate from said first shorting posts and said slot, said second shorting posts being electrically connected to said conductive upper plane and selectively electrically connected to at least one of said lower ground plane and said frequency-selective surface upon application of a selection signal applied to said second shorting pins.

2. The reconfigurable resonant cavity structure as recited in claim 1, wherein at least one of said first shorting posts and said second shorting posts comprises an electrically conductive switch adapted to selectively electrically connect and electrically isolate said conductive upper plane and at least one of said ground plane and said frequency selective surface.

3. The reconfigurable resonant cavity structure as recited in claim 2, wherein said electrically conductive switch comprises a light-actuated switch.

4. The reconfigurable resonant cavity structure as recited in claim 3, wherein said light-actuated switch comprises at least one from the group: optically-actuated microelectromechanical switch, PIN diode, other optically controlled switching device.

5. The reconfigurable resonant cavity structure as recited in claim 2, wherein said electrically conductive switch comprises an FET.

6. The reconfigurable resonant cavity structure as recited in claim 2, wherein said electrically conductive switch comprises a laser-activated semiconductor material adapted to liberate free carriers when illuminated by laser light having a predetermined wavelength so as to become conductive in at least one predetermined frequency band.

7. The reconfigurable resonant cavity structure as recited in claim 2, wherein said at least one frequency selective surface comprises two frequency selective surfaces, and wherein a first of said two frequency selective surfaces has a unit cell periodicity different from the unit cell periodicity of the second of said two frequency selective surfaces, whereby the reflective and absorptive characteristics of said two frequency selective surfaces may be controlled.

8. The reconfigurable resonant cavity structure as recited in 2, wherein said first and second shorting posts are substantially perpendicular to said conductive upper plane.

9. A reconfigurable resonant cavity structure, comprising:

a) a conductive upper plane having a slot therein forming a slot radiator;

b) a lower ground plane substantially parallel to said conductive upper plane and spaced apart therefrom;

c) a dielectric layer intermediate said conductive upper plane and said lower ground plane;

d) a frequency-selective surface disposed on a surface of said at dielectric layer;

e) first shorting posts comprising light-actuated microelectromechanical switches spaced apart from said slot and electrically connected to said conductive upper plane and to at least one of said lower ground plane and said frequency-selective surface; and f) second shorting posts comprising light-actuated microelectromechanical switches disposed intermediate said first shorting posts and said slot, said second shorting posts being electrically connected to said conductive upper plane and selectively electrically connected to at least one of said lower ground plane and said frequency-selective surface upon application of a selection signal applied to said second shorting pins.

10. The reconfigurable resonant cavity structure as recited in 9, wherein said first and second shorting posts are substantially perpendicular to said conductive upper plane.

11. A reconfigurable resonant cavity structure, comprising: a plurality of electrically conductive posts disposed in a predetermined pattern within a resonant cavity, at least a portion of said electrically conductive posts comprising switching elements to selectively electrically connect and disconnect said electrically conductive posts from at least one conductive surface within said resonant cavity; groups of said electrically conductive posts forming electrically movable fences within said resonant cavity, whereby the resonant characteristics of said resonant cavity may be modified by selectively connecting and disconnecting said at least a portion of said plurality of electrically conductive posts.

12. The reconf igurable resonant cavity structure as recited in claim 11, wherein said switching elements comprise electrically conductive, light-activated switches.

13. The reconfigurable resonant cavity structure as recited in claim 12, wherein said electrically conductive, light-actuated switches comprise at least one from the group: optically-actuated microelectromechanical switch, PIN diode, other optically controlled switching device.

14. The reconfigurable resonant cavity structure as recited in claim 12, wherein said electrically conductive, light-activated switches comprise FETs.

15. The reconfigurable resonant cavity structure as recited in claim 12, wherein said electrically conductive, light-activated switches comprise laser-activated semiconductor material adapted to liberate free carriers when illuminated by laser light having a predetermined wavelength so as to become conductive in at least one predetermined frequency band.

16. The reconfigurable resonant cavity structure as recited in claim 11, further comprising at least one frequency selective surface disposed within said reconfigurable resonant cavity.

17. The reconfigurable resonant cavity structure as recited in claim 16, wherein said at least one frequency selective surface comprises two frequency selective surfaces, and wherein a first of said two frequency selective surfaces has a unit cell periodicity different from the unit cell periodicity of the second of said two frequency selective surfaces, whereby the reflective and absorptive characteristics of said two frequency selective surfaces may be controlled.

* * * * *